US006771017B2

(12) United States Patent
Nishizawa et al.

(10) Patent No.: US 6,771,017 B2
(45) Date of Patent: Aug. 3, 2004

(54) COLOR CATHODE RAY TUBE AND METHOD OF MANUFACTURING THEREOF

(75) Inventors: Masahiro Nishizawa, Mobara (JP); Norikazu Uchiyama, Chikura (JP); Maki Taniguchi, Ichihara (JP); Toshio Tojo, Ichinomiya (JP); Tomoji Oishi, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 148 days.

(21) Appl. No.: 10/041,370

(22) Filed: Jan. 8, 2002

(65) Prior Publication Data

US 2002/0145377 A1 Oct. 10, 2002

(30) Foreign Application Priority Data

Jan. 30, 2001 (JP) ..... 2001-021356

(51) Int. Cl.[7] ..... H01J 31/00; H01J 5/16

(52) U.S. Cl. ..... 313/479; 313/477 R; 313/478; 313/461; 313/110

(58) Field of Search ..... 313/477 R, 478, 313/479, 110, 112, 116, 117, 461, 466, 473, 474

(56) References Cited

U.S. PATENT DOCUMENTS

| | | | | | |
|---|---|---|---|---|---|
| 5,789,854 | A | * | 8/1998 | Takizawa et al. | 313/478 |
| 5,965,975 | A | * | 10/1999 | Chigusa et al. | 313/478 |
| 6,084,343 | A | * | 7/2000 | Van De Poel et al. | 313/478 |
| 6,143,418 | A | * | 11/2000 | Takamiya et al. | 428/434 |
| 6,356,012 | B1 | * | 3/2002 | Bae | 313/479 |
| 6,476,969 | B2 | * | 11/2002 | Oka et al. | 359/582 |
| 2002/0175615 | A1 | * | 11/2002 | Wang et al. | 313/479 |

* cited by examiner

*Primary Examiner*—Nimeshkumar D. Patel
*Assistant Examiner*—German Colón
(74) *Attorney, Agent, or Firm*—Milbank, Tweed, Hadley & McCloy, LLP

(57) ABSTRACT

A cathode ray tube includes a film which is formed on an outer surface of a panel portion. The film is comprised of a first particles which become transparent due to the oxidation and a second particles which are chemically and physically stable and have the light absorbing ability and the conductivity. A number of the transparent first particles is gradually increased toward a peripheral portion from the center portion of the panel portion.

13 Claims, 7 Drawing Sheets

COLOR CATHODE RAY TUBE AND METHOD OF MANUFACTURING THEREOF

BACKGROUND OF THE INVENTION

1. Field of the Invention

The present invention relates to a cathode ray tube which enhances the uniformity of the brightness of an image display surface, and more particularly to a cathode ray tube which can make the brightness substantially uniform over the entire region of a panel portion by reducing the difference of light transmittivity between a center portion and a peripheral portion of the panel portion of the cathode ray tube which constitutes the image display surface and a manufacturing method thereof.

2. Description of the Related Art

Recently, cathode ray tubes which are called "flat face type" or "planer panel type" have been popularly adopted as video tubes of television receiver sets or monitor tubes of personal computers or the like.

As panels which use glass as material thereof, a superclear panel, a clear panel, a semiclear panel, a gray panel, a tint panel, a dark tint panel and the like have been known in descending order of transparency. Currently, so-called semiclear panels have been popularly used in view of the reduction of the reflectivity of an external light by the panel per se and the reduction of the reflection of an external light due to phosphor coated on an inner surface of the panel.

Further, with respect to a related art which can suppress the reflection and the electrification of an outer surface, followings can be named. First of all, a cathode ray tube disclosed in Japanese Laid-open Patent Publication 345737/1992 is provided with a light selection/absorption layer between an inner surface of a panel portion and a phosphor layer. This light selection/absorption layer is a mixture made of more than two kinds of substances including dye or pigment made of organic compound or inorganic compound, wherein the particle size of the dye or the pigment is set to not more than 1.0 $\mu$m and the light selection/absorption layer has two or more optical absorption peaks.

Further, on an outer surface of the panel portion, a mixture layer made of conductive material and binder, a single-layer reflection prevention film having the refractive index lower than that of glass which constitutes the panel portion, a multilayered reflection prevention film which is constituted of two to four layers having different refractive indices, or a film which mixes minute conductive particles made of ATO (Antimony Tin Oxide), ITO (Indium Tin Oxide) or the like in the multilayered reflection prevention film is formed.

Further, in Japanese Laid-open Patent Publication 182604/1993, a cathode ray tube which coats a coloring agent onto an outer surface of a panel portion and makes the density of the panel portion high at a center portion and low at a peripheral portion to make the light transmittivity of a panel uniform is disclosed. According to the invention disclosed in this publication, the coloring agent is mixed into a binder made of silica and is coated onto the outer surface of the panel portion by spraying and then a conductive agent which contains no coloring agent is sprayed onto the sprayed conductive agent so as to form irregularities on the surface of the panel portion. The glossiness (gloss value) derived from the irregularities on the surface can be adjusted by changing an amount of ethylene glycol added to the coating liquid.

Further, according to the invention disclosed in U.S. patent specification 4815821, a first transparent layer having the refractive index higher than that of panel glass is arranged to be brought into contact with an inner surface of a panel portion of a color cathode ray tube, an opaque pattern (light absorption matrix: black matrix (BM)) is formed on the first transparent layer, and a second transparent layer having the refractive index smaller than that of the first transparent layer is formed on the opaque pattern. The refractive index of the first transparent layer is set to 1.7 to 2.0 and the film thickness of respective transparent layers is set to ¼ of the wavelength of a visible light.

SUMMARY OF THE INVENTION

The present invention can provide a flat-panel type cathode ray tube which exhibits a favorable flat feeling, enhances the uniformity of brightness over the whole screen, and exhibits the excellent contrast and the color reproductive range. Further, the present invention can provide a manufacturing method of flat-panel type cathode ray tubes which can reduce the manufacturing cost and can easily manufacture flat-panel type cathode ray tubes.

A typical constitution of a cathode ray tube according to the present invention includes a light transmission control layer which is formed of a mixture layer which is comprised of a first material containing particles which become transparent due to the irradiation of light or due to the irradiation of light and the oxidation on an outer surface of a panel portion which forms an image display surface and a second material containing particles which are chemically and physically stable and has the light absorbing ability and the conductivity, wherein the distribution of the transparent particles which constitute the first material has a gradation in which the number of the particles is small at a center portion of the panel portion and is continuously increased toward a peripheral portion of the panel portion.

Further, a low refractive index layer which has a refractive index lower than that of the light transmission control layer is formed as a layer above the light transmission control layer. The light transmission control layer is fixed to the panel portion, and a portion of the low refractive index layer is impregnated into the light transmission control layer to establish a stable physical and chemical bonding between the first material and the second material.

As a preferred example of the first material, silver, aluminum, halogen compound or silver sulfide is used. As a preferred example of the second material, precious metal (gold, platinum, silver or the like), nickel, chromium, titanium nitride, or a mixture of indium tin oxide (hereinafter referred to as "ITO") and a light absorption material is used.

Due to such a constitution, it becomes possible to obtain the substantially uniform brightness (luminance) over the whole region of the panel portion without providing the gradation of thickness between the light transmission control layer and the low refractive index layer formed on the outer surface of the panel portion. Further, when the light transmission control layer has the conductivity, the light transmission control layer functions as an electrification prevention layer and can also suppress the undesired electromagnetic radiation.

Further, a typical constitution of a manufacturing method of cathode ray tubes according to the present invention includes:

a step in which a first coating layer is formed such that a first dispersing liquid which is produced by mixing a first material which contains metal particles which become transparent due to the irradiation of light or the irradiation of light and the oxidation and a second material which contains metal particles or metal oxide particles which are chemically and physically stable, exhibit the light absorption ability and hold the conductivity into a solvent is coated onto an outer surface of a panel portion using a spin method, a step in which a gradation exposure is applied to the panel portion such that the first coating layer is exposed in the oxidative atmosphere through an optical filter which exhibits the small transmittivity at the center of the panel portion and increases the transmittivity toward a periphery of the panel portion, and the metal particles which become transparent due to the irradiation of light or due to the irradiation of light and the oxidation are made transparent corresponding to an exposure light quantity which passes through the optical filter, and a step in which a second dispersing liquid is coated onto the exposed first coating layer using a spin method, the first coating layer is fixed to the panel portion and the second coating layer which exhibits a refractive index lower than that of the first coating layer is formed and, thereafter, the second coating layer is baked.

As the second dispersing liquid, a hydrolysis liquid of silicon alkoxide which contains or does not contain a reducing agent can be preferably used. When the hydrolysis liquid contains the reducing agent, thiouric acid or hydroquinone is used as the reducing agent. Further, when the particles contained in the first material is metal, metal particles having the ionization tendency greater than that of the metal is used as the reducing agent.

As the first material, metal, halogen compound or metal sulfide is preferably used, while as the second material, the metal, metal oxide, metal nitride or a mixture of metal oxide and a light absorption material is preferably used.

As a preferred example of the first material, silver, aluminum or silver sulfide is named, while as a preferred example of the second material, precious metal (gold, platinum, silver or the like), nickel, chromium, titanium nitride or a mixture of ITO and a light absorption material is named.

Since the first material and the second material which are formed by lamination on the outer surface of the panel portion can be coated using the spin method, it becomes no more necessary to use the spin method together with a spray method and hence, the reduction of the manufacturing cost can be easily achieved by simplifying the manufacturing facilities.

As the matter of course, the manufacturing method of the present invention can use the spray method together with the spin method. That is, when an existing facility is provided with a spray coating device and the first material and the second material can be coated with a uniform thickness using such a spray coating device, it is unnecessary to introduce a spin coating device particularly. In such a case, if the spin coating device can be also used, the coating of uniform thickness can be achieved more easily.

Further, the present invention is not limited to the above-mentioned constitution and a flat-panel type cathode ray tube which will be explained in embodiments described hereinafter and is applicable to a cathode ray tube having a panel portion whose outer surface is formed of a curved surface or other similar image display device whose light transmittivity is different between a center portion and a peripheral portion in the similar manner.

DESCRIPTION OF THE PREFERRED EMBODIMENTS

Preferred embodiments of the present invention are explained in detail in conjunction with drawings which show such embodiments hereinafter.

Figure 1A:
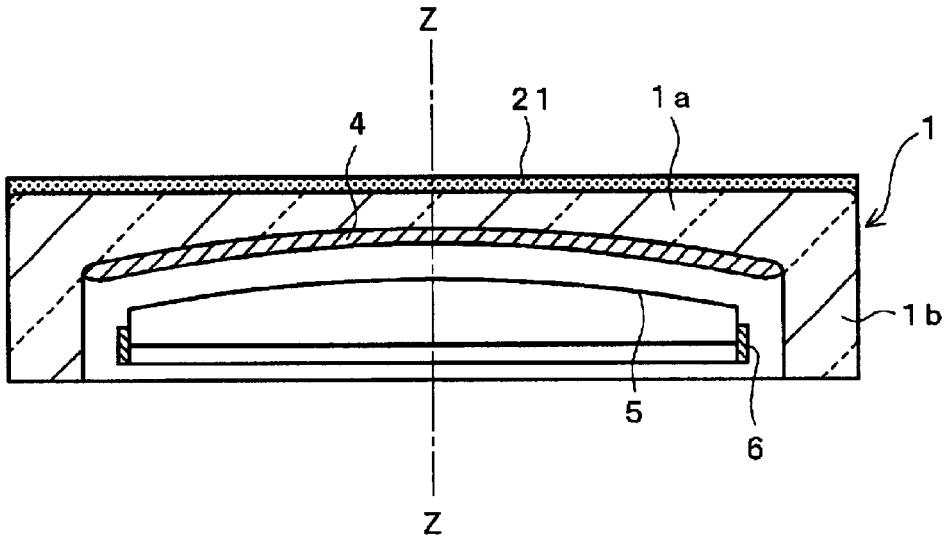
FIG. 1A is a cross-sectional view which schematically shows the structure of a panel portion of a cathode ray tube according to the present invention.
Figure 1B:
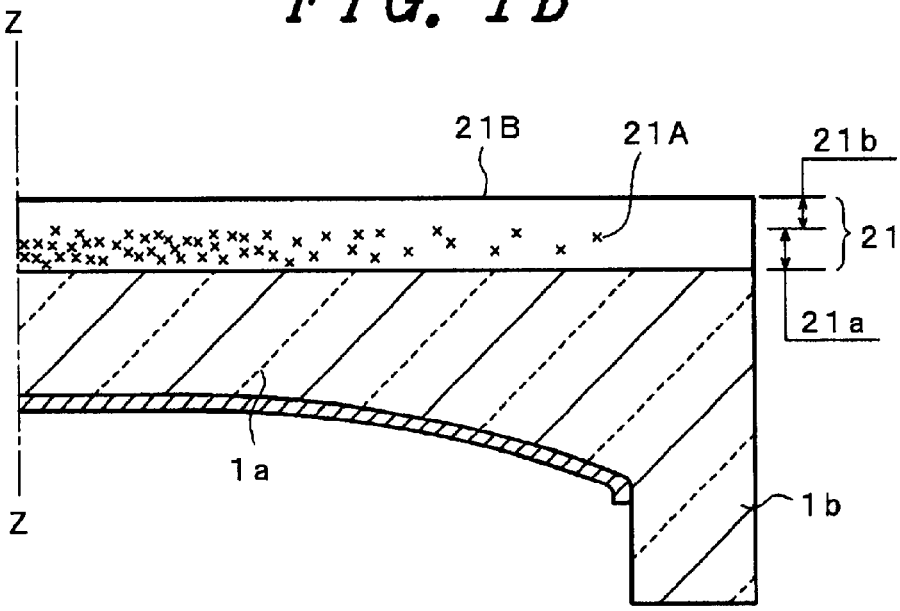
FIG. 1B is a partial enlarged view of FIG. 1A.

FIG. 1A and FIG. 1B are cross-sectional views for schematically showing the structure of a panel portion of a shadow-mask type color cathode ray tube to explain a first embodiment of a cathode ray tube according to the present invention, wherein FIG. 1A is a cross-sectional view in the state that a shadow mask is mounted on an inner surface of the panel portion and FIG. 1B is a cross-sectional view of a essential part to explain the structure of the panel shown in FIG. 1A.

In FIG. 1A, numeral 1 indicates a panel portion of a cathode ray tube, numeral 1*a* indicates a face plate portion of the panel portion 1, numeral 1*b* indicates a skirt portion of the panel portion 1, numeral 4 indicates a phosphor layer which is formed on an inner surface of the panel portion 1, and numeral 5 indicates a shadow mask which is fixed to a mask frame 6 and is supported by a suspension mechanism not shown in the drawing. Further, numeral 21 indicates a film (including a light transmission control layer 21*a* and a low refractive index layer 21*b*) which is formed on an outer surface of a screen portion of the panel portion 1, and Z—Z indicates a tube axis of the color cathode ray tube.

The film 21 which is formed on the outer surface of the screen portion of the panel portion 1 has a two-layered structure which is formed by laminating the low refractive index layer 21*b* to the light transmission control layer 21*a* as an upper layer as shown in FIG. 1B in an enlarged manner.

The light transmission control layer 21*a* contains ultra-fine metal particles 21A which become transparent due to the irradiation of light or the irradiation of light and the oxidation. These ultra-fine metal particles 21A are subjected to the transparentization treatment in which the transparency of the panel portion 1 is low at a center portion thereof and is increased toward a peripheral portion thereof due to the gradation exposure which will be explained later. That is, the light transmittivity of the light transmission control layer 21*a* is small at the center portion and is large at the peripheral portion. Further, the magnitude of the transmittivity is expressed by the ultra-fine metal particles 21A which are not made transparent and remain in an opaque state as shown in FIG. 1B.

The low refractive index layer 21*b* is obtained by coating a hydrolysis liquid of silicon alkoxide on the light transmission control layer 21*a* after exposing the light transmission control layer 21*a*, and the light transmission control layer 21*a* which is arranged below the low refractive index layer 21*b* is fixed to a surface (outer surface) of the panel portion 1 in this coating step and a succeeding baking step.

Further, the light transmission control layer 21*a* has the conductivity, functions as an electrification prevention layer of the panel portion 1, and performs an action to suppress undesired electromagnetic radiation.

According to the cathode ray tube having the structure of the first embodiment, it becomes possible to obtain the substantially uniform brightness (luminance) over the whole region of the panel portion while ensuring the uniform thickness of the film 21 over the whole surface of the panel portion 1. Further, since the light transmission control layer 21*a* has the conductivity, the light transmission control layer 21*a* functions as the electrification prevention layer and can suppress the undesired electromagnetic radiation.

Subsequently, an embodiment of a manufacturing method of cathode ray tubes according to the present invention is explained in detail.

Figure 2:
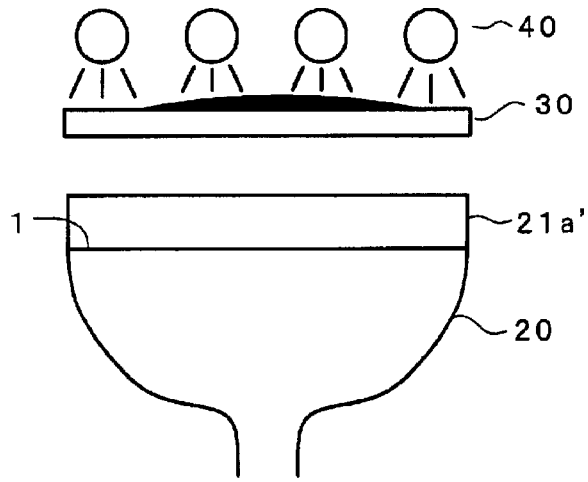
FIG. 2 is a schematic view of a gradation exposure device which is served for explaining a manufacturing method of cathode ray tubes according to the present invention.

FIG. 2 is a schematic view of a gradation exposure device which is served for the manufacturing method of the cathode ray tube according to the present invention. In the drawing, numeral 20 indicates a cathode ray tube, 21*a*' indicates a first layer which constitutes the light transmission control layer 21*a*, 30 indicates an optical filter, numeral 40 indicates a low-pressure mercury lamp.

The exposure is performed by disposing the optical filter 30 whose transmittivity is small at the center of the panel portion and is increased toward a periphery thereof above the first layer 21*a*' which constitutes the light transmission control layer coated on a panel portion 1 of the cathode ray tube 20.

Figure 3:
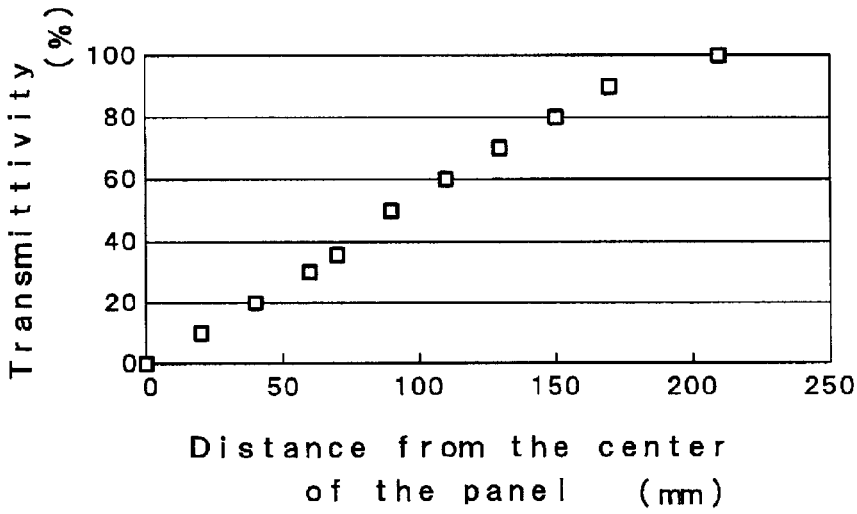
FIG. 3 is an explanatory view of the transmittivity distribution of an optical filter used in the manufacturing method of cathode ray tubes according to the present invention.
Figure 4:
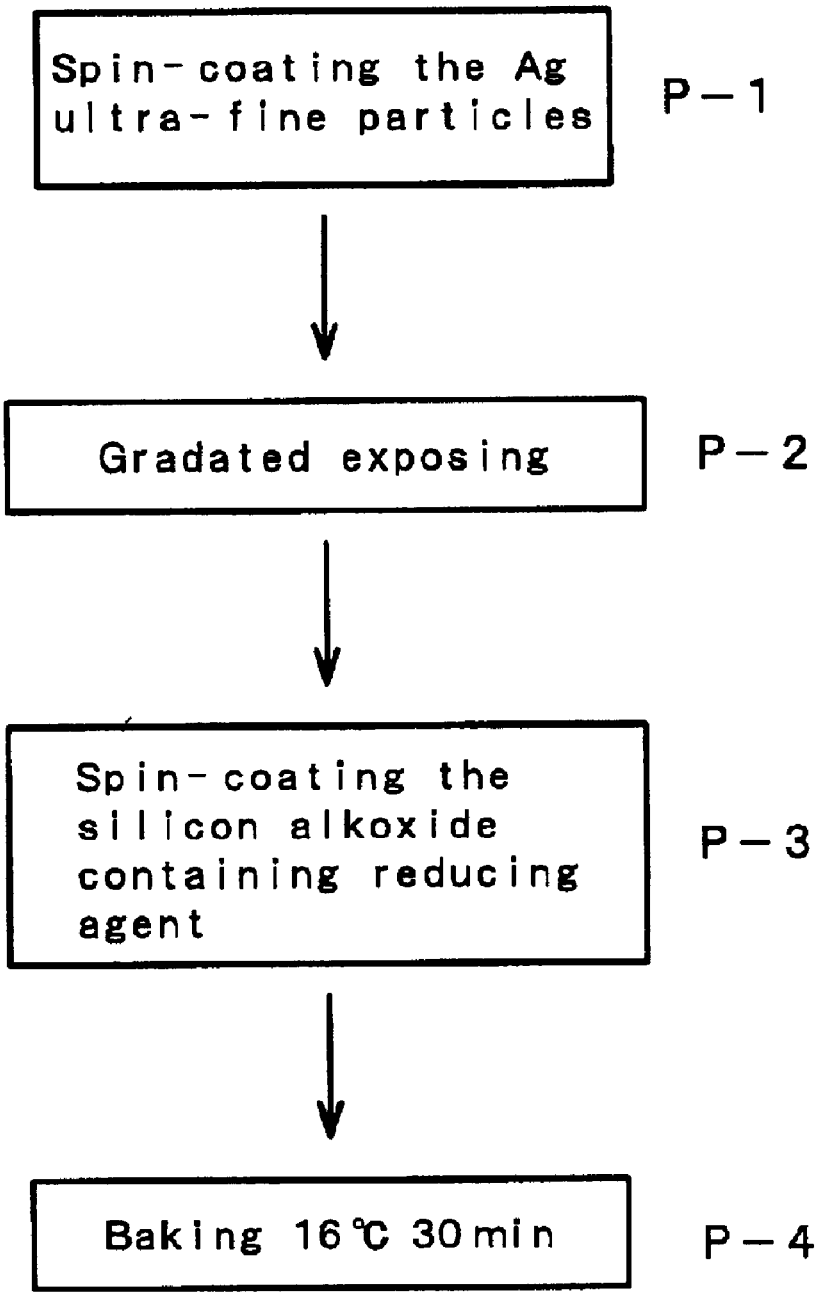
FIG. 4 is a general step view for explaining the manufacturing method of cathode ray tubes according to the present invention.

FIG. 3 is an explanatory view showing the transmittivity distribution of the optical filter used in the first embodiment, wherein the distance (mm) from the center of the panel is taken on an axis of abscissas and the transmittivity (%) of the optical filter is taken on an axis of ordinates. The optical filter 30 is a semipermeable film filter which is formed by vapor-depositing nickel (Ni) onto a quarts plate and has the light transmission distribution of 0% at the center and 100% at the periphery. As the low-pressure mercury lamp 40, a lamp in which the main wavelength of irradiated ultraviolet rays is 254 nm and the intensity of light is 10 W/m$^2$ is used. FIG. 4 is a general step view of this embodiment and the manufacturing method of cathode ray tubes according to the present invention is explained in accordance with the order of steps.

Here, the explanation is made with respect to a flat-panel type cathode ray tube having an effective screen diagonal size of 46 cm. As the flat-panel type cathode ray tube having the effective screen diagonal size of 46 cm, a cathode ray tube in which the light transmittivity of the panel portion is set to approximately 78% at the center portion and approximately 67% at the peripheral portion and the thickness of the panel portion is set to approximately 11.5 mm at the center portion and approximately 24.5 mm at the peripheral portion is used.

Step 1 (P-1)

After cleaning the panel portion of the cathode ray tube by a cleaning method used in a usual sol-gel method, the panel portion is dried and is mounted on a spin coating device. Then, a solution (a first liquid) having the composition shown in Table 1 is coated on the panel portion by adjusting the surface temperature of the panel portion to approximately 35±1° C. The rotational speed of the panel portion in the spin coating device is set to 150 rpm and the time is set to 30 seconds and the first layer 21*a*' which becomes the light transmission control layer 21*a* having the uniform thickness of 40 nm is coated.

TABLE 1

| component | | concentration (wt %) |
|---|---|---|
| Ag—Pd—Au ultra-fine particle alloy colloid | (particle size 4 to 8 nm) | 0.15 |
| Ag ultra-fine particle colloid | (mean particle size 1.5 nm) | 0.15 |
| Pd ultra-fine particle colloid | (mean particle size 1.0 nm) | 0.10 |
| Au ultra-fine particle colloid | (mean particle size 1.5 nm) | 0.10 |
| deionized water | | 60 |
| ethyl alcohol | | balance |

The panel portion is exposed using the gradation exposure device shown in FIG. 2 so as to oxidize the ultra-fine particles of silver (Ag) such that the ultra-fine particles became gradually transparent from the center portion to the peripheral portion of the panel portion.

The exposure is made by disposing the optical filter 30 whose transmittivity at the center of the panel portion is small and is increased toward the periphery of the panel portion above the first layer 21*a*' which is coated on the panel portion 1 of the cathode ray tube 20 and constitutes the optical transmission control layer.

Step 2 (P-2)

The exposure is performed for approximately 30 seconds in air using the above-mentioned gradation exposure device. Although a low-pressure mercury lamp in which the main wavelength of the irradiated light is 365 nm and the intensity of light is 14 W/m$^2$ is used, the exposure for approximately 30 seconds is sufficient.

Silver and oxygen which are activated by this exposure react with each other thus forming transparent silver oxide (AgO). In accordance with the transmittivity distribution of the optical filter 30, the ultra-fine particles of silver in the first layer 21*a*' gradually became transparent silver oxide from the center to the periphery of the first layer 21*a*'. The number of the ultra-fine particles of transparent silver oxide gradually increase from the center to the periphery of the first layer 21*a*'.

Due to the exposure for approximately 30 seconds, a semipermeable film having the light transmittivity of approximately 82% at the peripheral portion of the panel portion 1 and the light transmittivity of approximately 70% at the center portion of the panel portion 1 is formed. The ultra-fine particle alloy colloid made of silver-palladium-gold (Ag—Pd—Au) in the solution having the composition of the first liquid is stable and has maintained the opaqueness as it is even after the exposure is completed.

Step 3(P-3)

After the completion of the exposure, the temperature of a surface of the panel portion is controlled to 45±1° C. and a solution (second liquid) of silicon alkoxide containing thiouric acid as a reducing agent having the composition shown in Table 2 is coated by spinning for approximately 30 seconds by setting the rotational speed of the spin coating device to 150 rpm. A coating film having a thickness of 70 to 80 nm is formed by this coating.

TABLE 2

| content | concentration (wt %) |
|---|---|
| tetraethoxysilane hydrolysis product | 1.0 |
| nitric acid (added to adjust to pH 4.0) | minute quantity |
| water | 20 |
| methyl alcohol | 50 |
| hydroquinone or thiourea | 0.5 |
| isopropyl alcohol | balance |

Step 4 (P-4)

Thereafter, the panel is baked for 30 minutes at a temperature of 160° C.

Accordingly, the low refractive index transparent film having a thickness of 70 to 80 nm is formed on the semipermeable film which constitutes the first layer formed in the step 1 and a portion of the second liquid is impregnated into the first layer so that the low refractive index transparent film is fixed to the glass surface of the panel portion 1 together with the first layer.

Figure 5:
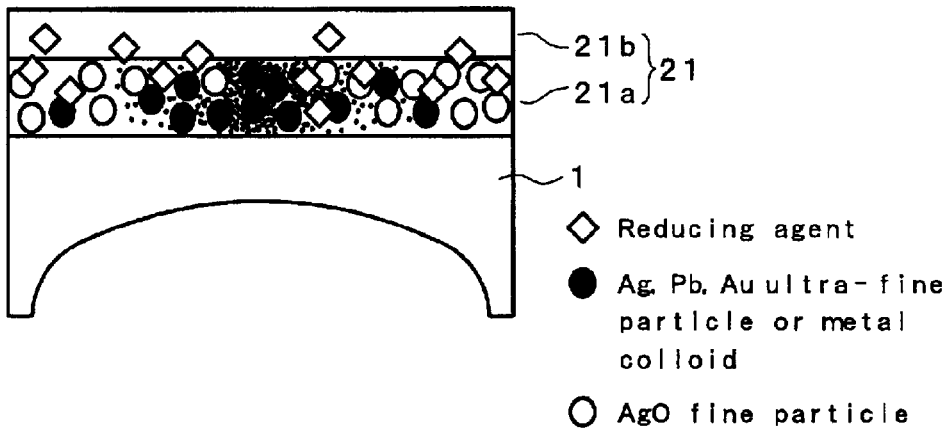
FIG. 5 is a schematic cross-sectional view for explaining the light transmission control and the structure of a low refractive index layer of a panel portion manufactured by the manufacturing method of cathode ray tubes according to the present invention.

FIG. 5 is a schematic cross-sectional view which explains the structure of the film 21 which is constituted of the light transmission control layer 21*a* and the light reflection control layer 21*b* which are formed on the panel portion 1 of the cathode ray tube manufactured in the first embodiment. In FIG. 5, the film 21 includes a reducing agent, ultra-fine particles or alloy colloid of precious metal (Ag, Pd, Au) and ultra-fine particles made of silver oxide (AgO).

In the first embodiment, the light transmission control layer 21*a* which is made of the mixture layer which is constituted of the first material containing the ultra-fine particles which become transparent due to the oxidation and the second material which contains the ultra-fine particles which are chemically and physically stable and have the light absorbing ability and conductivity and has the inclination of the light transmittivity which is small at the center portion of the panel portion and is continuously increased toward the peripheral portion is formed on the outer surface of the panel portion 1. Further, the low refractive index layer 21*b* which has the refractive index lower than that of the light transmission control layer 21*a* is formed on the light transmission control layer 21*a*.

Then, a portion of the low refractive index layer 21*b* is impregnated between the first material and the second material so as to stabilize the transparent material and to fix the light transmission control layer 21*a* to the surface of the panel portion 1 whereby the film 21 is formed.

Due to the above-mentioned reducing agent and the heating effect at the time of baking, the remaining activated silver (Ag) particles which are not oxidized by exposure form alloys with palladium (Pd) and gold (Au) or return to stable silver (Ag) ultra-fine particles so that the stable state can be maintained in spite of the presence of various kinds of physical and chemical stresses.

The optical transmittivity of the film 21 formed in the first embodiment is approximately 70% at the center portion of the panel portion and approximately 82% at the peripheral portion of the panel portion. When this light transmittivity is multiplied with the light transmittivity of the panel portion per se, the light transmittivity is approximately 55% at the center portion as well as at the peripheral portion so that the non-uniformity of the light transmittivity derived from the difference of glass thickness of the panel portion 1 is obviated so that the uniformity of the brightness (luminance) over the entire region of the screen which is important as a display is also maintained.

Further, with respect to the film 21 formed in the first embodiment, the surface resistance is 500 Ω/□ at the center portion and 800 Ω/□ at the peripheral portion, while the luminous reflectance is 0.3% at the center portion and 0.9% at the peripheral portion so that a cathode ray tube which holds the undesired electric field radiation prevention performance and the reflection prevention performance which are required to be satisfied by the cathode ray tube is obtained.

Steps of the second embodiment of the present invention are similar to those of the first embodiment, wherein the compositions shown in Table 3 are used as the first liquid and the second liquid in the first embodiment.

TABLE 3

| first liquid | | second liquid | |
|---|---|---|---|
| content | concentration (wt %) | content | concentration (wt %) |
| Ag—Pd ultra-fine particle alloy colloid (particle size 4 to 8 nm) | 0.2 | tetraethoxysilane hydrolysis product | 1.0 |
| Ag ultra-fine particle colloid (1.5 nm) | 0.2 | hydrochloric acid (pH adjusting agent) | minute quantity |
| Pd ultra-fine particle colloid (1.0 nm) | 0.2 | iron ultra-fine particle colloid (1.5 nm) | 0.02 |
| deionized water | 60 | water | 20 |
| ethyl alcohol | balance | methyl alcohol | 10 |
| — | — | isopropyl alcohol | balance |

In the second embodiment, in place of the reducing agent in the second liquid, iron colloid is used as metal which exhibits the light absorbing ability and the low resistance and has the larger ionization tendency than precious metal. With the use of this iron colloid, the oxidation of silver (Ag) ultra-fine particles activated by ultra-violet rays is suppressed and hence, is stabilized.

Although the above-mentioned iron colloid may be added to the first liquid, the addition of the iron colloid gives an adverse effect to the precious metal alloy and shortens the lifetime of the liquid to some extent so that it is preferable to add this iron colloid to the second liquid.

The optical transmittivity of the film 21 formed in the second embodiment is approximately 70% at the center portion of the panel portion and approximately 82% at the peripheral portion of the panel portion. When this light transmittivity is multiplied with the light transmittivity of the panel portion per se, the light transmittivity is approximately 55% at the center portion as well as at the peripheral portion so that the non-uniformity of the light transmittivity derived from the difference of glass thickness of the panel portion is obviated so that the uniformity of the brightness (luminance) over the entire region of the screen which is important as a display is also maintained.

Further, with respect to the film 21 formed in the second embodiment, the surface resistance is 500 Ω/□ at the center portion and 800 Ω/□ at the peripheral portion, while the luminous reflectance is 0.3% at the center portion and 0.9% at the peripheral portion so that a cathode ray tube which holds the undesired electric field radiation prevention and the reflection prevention performance which are required to be satisfied by the cathode ray tube is obtained.

Although the third embodiment uses steps similar to those of the first embodiment, as a solution which is served for forming the light transmission control layer 21*a*, the composition shown in Table 4 which is formed by adding pigment (carbon black, for example) which has the light absorbing ability and metal oxide colloid to the first liquid is used.

As the solution which is served for forming the low refractive index layer 21*b*, the compositions shown in Table 2 or Table 3 is used. In the third embodiment, the concentration of the tetraethoxysilane hydrolysis liquid in the embodiment 1 or 2 is set to 1.5 wt %.

TABLE 4

| content | | concentration (wt %) |
|---|---|---|
| ITO (Indium-Tin-Oxide) | (particle size 30 nm) | 3 |
| carbon black | (particle size 1.5 nm) | 0.1 |
| Ag ultra-fine particle colloid | (particle size 1.5 nm) | 0.2 |
| Pd ultra-fine particle colloid | (particle size 1.0 nm) | 0.1 |
| deionized water | | 55 |
| sodium dodecylbenzene sulfonic acid | | 0.02 |
| ethyl alcohol | | balance |

In the same manner as the above-mentioned respective embodiments, the optical transmittivity of the film 21 formed in the third embodiment also is approximately 70% at the center portion of the panel portion and approximately 82% at the peripheral portion of the panel portion. When this light transmittivity is multiplied with the light transmittivity of the panel portion per se, the light transmittivity is approximately 55% at the center portion as well as at the peripheral portion so that the non-uniformity of the light transmittivity derived from the difference of glass thickness of the panel portion is obviated so that the uniformity of the brightness (luminance) over the entire region of the screen which is important as a display is also maintained.

Further, with respect to the film 21 formed in the third embodiment, the surface resistance is 500 Ω/□ at the center portion and 800 Ω/↑ at the peripheral portion, while the luminous reflectance is 0.3% at the center portion and 0.9% at the peripheral portion so that a cathode ray tube which holds the undesired electric field radiation prevention and the reflection prevention performance which are required to be satisfied by the cathode ray tube is obtained.

Although the above-mentioned respective embodiments explain typical manufacturing methods of cathode ray tubes according to the present invention, titanium nitride or ruthenium or the like which is usually used in this type of sol-gel method can be used in place of the precious metal or ITO which constitutes the substrate of the film, to obtain the substantially same advantageous effects.

Further, the light transmission control film according to the present invention can be formed as known substrates of a sputter film and a membrane having reflection prevention/electrification prevention functions. The alloy colloid component may be omitted from the above-mentioned first liquid.

Other embodiments of the manufacturing method of cathode ray tubes according to the present invention are explained hereinafter.

In the fourth embodiment, a solution which eliminates alloy colloid described in Table 5 is used as the composition of the light transmission control layer.

TABLE 5

| content | concentration (wt %) |
|---|---|
| Ag ultra-fine particle colloid (particle size 1.5 nm) | 0.3 |
| Pd ultra-fine particle colloid (particle size 1.0 nm) | 0.2 |
| Au ultra-fine particle colloid (particle size 1.5 nm) | 0.2 |
| deionized water | 60 |
| ethyl alcohol | balance |

When the light transmission control layer is formed by using the first liquid having such composition, this first liquid is inferior physically and chemically to the first liquid which contains the alloy colloid. However, the light transmission control characteristics of a degree which causes no practical problem can be obtained.

The fifth embodiment uses the first liquid to which dyes shown in Table. 6 are added to give the selective absorbing ability of light to the light transmission control layer. Further, the fifth embodiment gives the gradation to the transmittivity by making use of the fading of dye generated by the irradiation of ultraviolet rays at the time of exposure using a process which is substantially same as that of the embodiment 1.

TABLE 6

| content | concentration (wt %) |
|---|---|
| acid red | 0.5 |
| anthraquinone-based blue dye | 0.15 |
| PCGreen 10P green (made of Nihon Kayaku Ltd.) | 0.10 |
| Ag—Pd ultra-fine particle alloy colloid | 0.30 |
| deionized water | 60 |
| ethyl alcohol | balance |

The sixth embodiment uses the first liquid to which dyes shown in Table 7 are added to give the selective absorbing ability of light to the light transmission control layer and gives the gradation to the transmittivity by making use of the fading of color of the dye due to the irradiation of ultraviolet rays at the time of exposure by performing a process which uses an exposure device similar to that of the embodiment 1.

TABLE 7

| first liquid | | second liquid | |
|---|---|---|---|
| content | concentration (wt %) | content | concentration (wt %) |
| qunacridone Red (particle size of pigment 60 nm) | 0.5 | tetraethoxysilane hydrolysis product | 1.5 |
| phthalocyanine green (particle size of pigment 40 nm) | 0.1 | hydrochloric acid (pH 3.0 adjusting agent) | minute quantity |
| Ag ultra-fine particle colloid (particle size 1.5 nm) | 0.15 | water | 20 |
| Pd ultra-fine particle colloid (particle size 1.0 nm) | 0.30 | methyl alcohol | 10 |

TABLE 7-continued

| first liquid | | second liquid | |
|---|---|---|---|
| content | concentration (wt %) | content | concentration (wt %) |
| deionized water | 60 | ethyl alcohol | balance |
| ethyl alcohol | balance | — | — |

The films which are manufactured using the fourth embodiment to the sixth embodiment described above can also obtain the substantially uniform brightness (luminance) over the whole area of the panel portion while maintaining the uniform thickness over the whole surface of the panel portion 1. Further, since the light transmission control layer has the conductivity, the light transmission control layer functions as an electrification prevention layer and can suppress the undesired electromagnetic irradiation.

Figure 6:
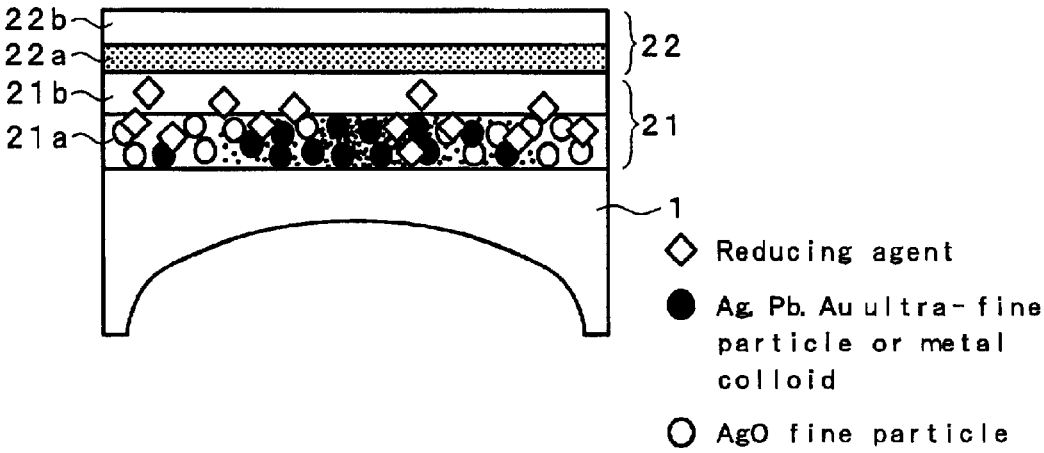
FIG. 6 is a schematic cross-sectional view for explaining the structures of an optical transmission control layer and a low refractive index layer which are formed by another embodiment of the manufacturing method of cathode ray tubes according to the present invention.

FIG. 6 is a schematic cross-sectional view which is served for explaining the structure of a light transmission control layer/low refractive index layer of a panel portion of a cathode ray tube formed by the seventh embodiment of the manufacturing method cathode ray tubes of the present invention. A film 21 shown in FIG. 6 includes a reducing agent, ultra-fine particles of precious metal (Ag, Pd, Au), alloy colloid of the precious metal, and ultra-fine particles of silver oxide (AgO).

In the seventh embodiment is, as shown in FIG. 6, the film 21 is formed on a lower layer of a conventional low-resistance reflection prevention/electrification prevention film 22 using a process similar to that of the first embodiment of the manufacturing method of the present invention. The process of the seventh embodiment is explained hereinafter.

Through the above-mentioned step 3 (P-3) shown in FIG. 4, a conductive layer 22*a* and a silica layer 22*b* is formed by spin coating on an upper layer of the light transmission control layer/low refractive index layer 21*b* before baking in the step 4 (P-4) so as to form the known reflection prevention/electrification prevention film 22. As material of the conductive layer 22*a*, ultra-fine particles made of Ag, Pd, Au or alloy colloid thereof can be used.

Thereafter, the baking is performed for 30 minutes at a temperature of 160° C. so as to form four-layered film (21*a*, 21*b*, 22*a*, 22*b*) on the outer surface of the panel portion 1.

The luminous reflectance of the four-layered film became 0.5% at the center portion as well as at the peripheral portion of the panel portion. This value is extremely small compared to that of the first embodiment and hence, the difference in the luminous reflectance between the center portion and the peripheral portion of the panel portion is dissolved.

Further, even when the known reflection prevention/electrification prevention layer 22 is formed on the lower layer of the film 21, the similar performance is obtained.

The eighth embodiment of the present invention can also form a film on the outer surface of the panel portion of the cathode ray tube using following methods.

(1) An ethyl alcohol solution containing silicon alkoxide is sprayed onto the two-layered film (light transmission control layer/low refractive index layer) which is formed in the first embodiment so as to make a surface which constitutes an outermost surface of the two-layered film coarse.

(2) Using an ultra high voltage mercury lamp (main wavelength: 365 nm, luminous intensity: 20 $W/m^2$) as an exposure light source of a gradation exposure device, a process similar to that of FIG. 4 is performed.

Further, by adding ozone into an exposure atmosphere at a rate of 5 to 10 ppm/air and by spraying air to the outer surface of the panel portion, the exposure time is shortened to 20 seconds.

(3) The atmosphere during the exposure is evacuated and ultraviolet rays of high energy (main wavelength: 185 nm, luminous intensity: 20 $W/m^2$) are irradiated to the panel portion. In this case, the exposure time is largely shortened to approximately 15 seconds. Here, Ag is exposed and became the activated state. Then, by taking out the panel portion from the vacuum and placing the panel portion in air, Ag is instantaneously oxidized and became the silver oxide. Thereafter, in the same manner as the previous embodiments, the reflection prevention/electrification prevention film is formed by coating the second layer.

The ninth embodiment is based on a finding that the transmittivity of the surface of the panel portion can be changed by a photo reaction between Ag colloid particles and a halogenated silane coupling agent and is achieved by making use of this finding.

First of all, 3.80 g of a solution which is obtained by adding and mixing bromopropyltriethoxysilane into an $SiO_2$ sol solution (0.8%) at a rate of 0.15 g of bromopropyltriethoxysilane relative to 7.87 g of the $SiO_2$ sol solution (0.8%) is mixed into 3.80 g of an Ag colloid dispersing liquid (2%). Subsequently, the mixture is subjected to an ultrasonic dispersing machine for five minutes. The solution is coated on the surface of the panel and is dried for 15 minutes at a temperature of 80° C.

This film gradually changed the transmittivity thereof in response to the light irradiation time and the irradiation strength. By irradiating ultraviolet rays at the wavelength of 365 nm and with the light intensity of 10 $mW/cm^2$, within the irradiation time of approximately 5 to 10 minutes, the transmittivity is gradually loared in the vicinity of 550 nm to 600 nm with respect to the transmittivity curve of an initial Ag-based film, and the color is changed to dark brown with respect to the observation of color of the film. When the irradiation time is further extended such that the film is subjected to the irradiation for 20 minutes, the transmittivity which is once loared in the vicinity of 550 nm to 600 nm is gradually elevated and hence, the absorption of the ultraviolet rays is dissipated. When the irradiation of ultraviolet rays is further continued, the absorption of ultraviolet rays by the film is extinguished and hence, the film became transparent.

That is, it is possible to change the transmittivity of the film by changing the irradiation time of light and hence, the color of the film can be changed from dark brown to transparent. This change can be also brought about by changing the irradiation intensity of light.

Making use of such a change of transmittivity of the film, after forming the film, by mounting a filter which is capable of changing the irradiation intensity of light from the center to the peripheral portion thereof with a gradient and then by irradiating light to the film through the filter, the film which can change the transmittivity from the center portion to the peripheral portion thereof by approximately 10 to 15% can be manufactured.

By applying such a technique to the surface treatment of the panel of the flat-face panel type (flat-panel type) cathode ray tube, the simple surface treatment film forming means which can correct the transmittivity difference of the glass which constitutes the panel (panel glass) can be commercialized.

Here, a phenomenon in which the transmittivity of the film is changed in response to the irradiation time of light or the irradiation intensity of light is estimated as follows. The Ag colloid and Br of bromopropyltrietoxysilane present in the film react with each other due to the optical energy so that the uniformly dispersed AgCl having the particle size of approximately 50 to 100 Å is generated thus reducing the transmittivity of the film.

When the optical energy is further applied to the Ag colloid and Br of bromopropyltrietoxysilane, the reaction further progresses and AgCl having the larger particle size is generated. Here, since the aggregation of AgCl is accelerated, the transmittivity of the film is increased whereby the film is considered to be shifted to the transparent state.

Besides the above-mentioned bromopropyltriethoxysilane, this reaction is also generated when alkoxisilane which is halogenated with iodine is used so that the transmittivity of the film can be changed in a wide range using alkoxisilane and, at the same time, the color of the film surface can be changed. Further, the degree of the above-mentioned change and the light irradiation time can be controlled in response to an addition amount of halogenated material.

Figure 7:
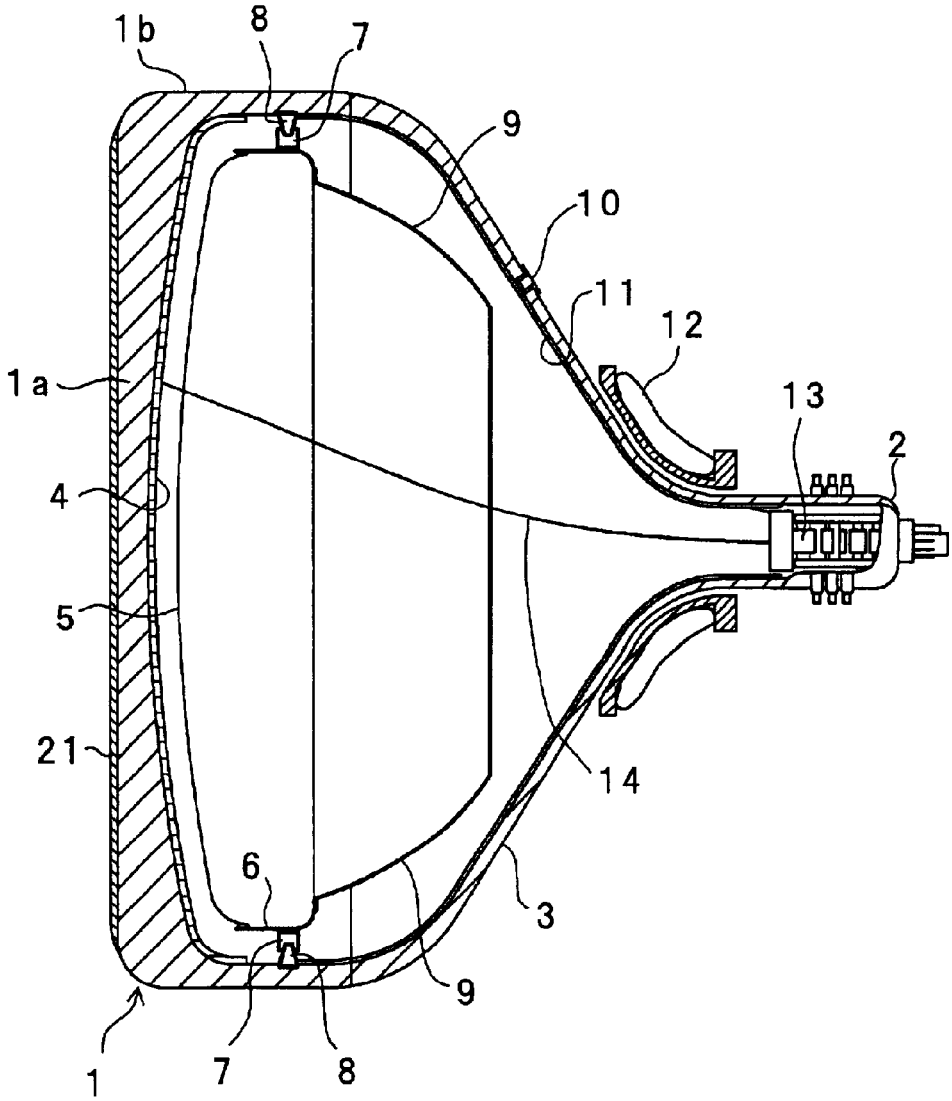
FIG. 7 is a schematic cross-sectional view showing the whole structure of a shadow-mask type color cathode ray tube to which the present invention is applied.

FIG. 7 is a schematic cross-sectional view showing the entire structure of a shadow-mask type color cathode ray tube as an example of the cathode ray tube obtained by the present invention. This color cathode ray tube includes a vacuum envelope which is constituted of a panel portion 1 which is provided with a phosphor layer on an inner surface thereof, a neck portion 2 which houses an electron gun 13, and a funnel portion 3 which connects the panel portion 1 and the neck portion 2. Then, the light transmission control layer/low refractive index layer 21 which has been explained with respect to the previously-mentioned embodiments is provided to an outer surface of the panel portion 1.

A phosphor layer 4 which is coated with phosphor of three colors consisting of red (R), green (G) and blue (B) in general in a mosaic shape or in a stripe shape is formed on an inner surface of the panel portion 1. A shadow mask 5 which constitutes a color selection electrode is arranged close to the phosphor layer 4.

The shadow mask 5 is of a self-standing type which is formed by a press. The shadow mask 5 has a periphery thereof welded to a mask frame 6 and is supported on stud pins 8 which are formed on an inner wall of a skirt portion 1*b* of the panel portion 1 in an erected manner by way of suspension springs 7. Here, a magnetic shield 9 is fixedly mounted on an electronic gun 13 side of the mask frame 6.

A deflection yoke 12 is exteriorly mounted on a transitional area of the vacuum envelope disposed between neck portion 2 and the funnel portion 3. By deflecting three modulated electron beams 14 which are irradiated from the electron gun 13 in the horizontal direction (X direction) as well as in the vertical direction (Y direction) using the deflection yoke 12, the electron beams 14 scan the phosphor layer 4 two-dimensionally thus reproducing images.

In FIG. 7, numeral 11 indicates an inner conductive film and is served for applying a high voltage introduced from an anode button 10 to a main lens forming anode electrode of the electron gun 13 and a conductive film formed on an upper layer of the phosphor layer.

The color cathode ray tube exhibits the general light transmittivity which is substantially equal between the periphery and the center of the panel portion 1 and hence, the color cathode ray tube can obtain an image display which has the favorable flat feeling, maintains the uniform brightness over the whole region, and exhibits excellent contrast and color reproducibility.

The present invention is not limited to the above-mentioned flat-panel type and is, as mentioned previously, is applicable to a cathode ray tube which has a curved panel outer surface or an image display device which exhibits the different light transmittivity between the center portion and the peripheral portion in the same manner as the cathode ray tubes of the previous embodiments.

A flat-surface panel type cathode ray tube forms an outer surface of a panel (also referred to as an image display surface, a screen, a face or the like) into a shape having a large radius of curvature to make the outer surface substantially flat from a viewpoint of the manufacturing cost and the easiness of manufacturing. On the other hand, such a flat-surface panel type cathode ray tube forms an inner surface on which a phosphor layer is formed into a shape which has a relatively small radius of curvature to an extent that a flat feeling of a displayed image is not damaged when the displayed image is viewed from the outside surface.

Figure 8:
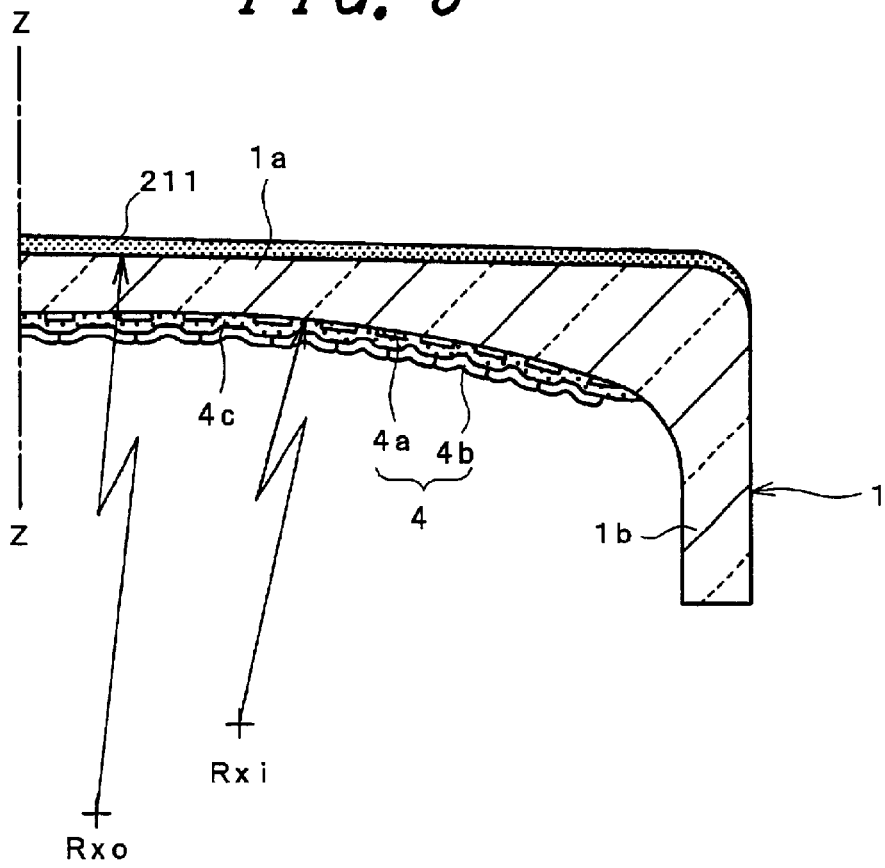
FIG. 8 is a cross-sectional view of an essential part for explaining a structural example of a panel portion of a flat panel type cathode ray tube provided with a film which is formed by using a spray coating device.
Figure 9:
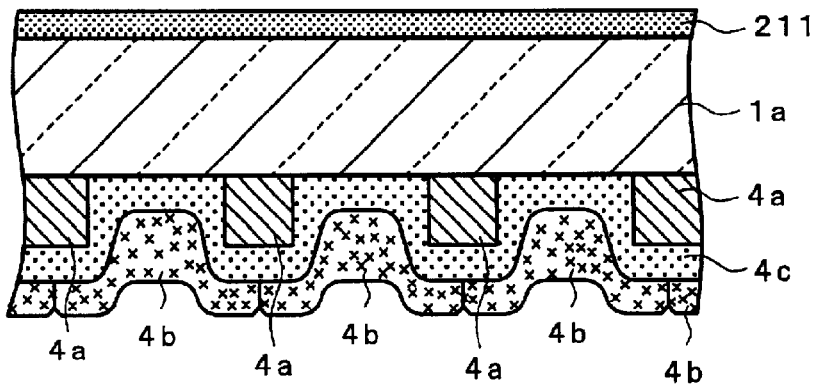
FIG. 9 is an enlarged cross-sectional view of the panel portion shown in FIG. 8.

FIG. 8 is a cross-sectional view of an essential part for explaining a constitutional example of the panel portion of the flat-surface panel type cathode ray tube. FIG. 9 is an enlarged cross-sectional view of the panel portion shown in FIG. 8. In these drawings, numeral 1 indicates the panel portion, numeral 1*a* indicates a face plate portion of the panel portion 1, numeral 1*b* indicates a skirt portion of the panel portion 1, numeral 211 indicates a film (including a reflection prevention layer, an electrification prevention layer and the like) which is formed on the outer surface of the panel 1, and Z—Z indicates a tube axis of the cathode ray tube.

Here, RXO indicates a radius of curvature of the outer surface of the panel and RXI indicates a radius of curvature of the inner surface of the panel, wherein the relationship between the radii RXO, RXI of curvature is set to RXO>>RXI.

In this type of color cathode ray tube, a black matrix (BM) 4*a* which constitutes a light absorption matrix is formed on the inner surface of the panel portion 1 and an inner light absorption layer 4*c* is formed such that the layer 4*c* covers the black matrix (BM) 4*a*. Phosphor 4*b* of three colors is formed on the inner light absorption layer 4*c*. The light absorption layer may be formed between the black matrix BM and the glass. The phosphor 4*b* of three colors is filled in recessed portions of the inner light absorption layer 4*c* which are formed of openings of the black matrix (BM) 4*a*. The color cathode ray tube may not be provided with the inner light absorption layer.

As shown in FIG. 8, the relationship between the radii RXO, RXI of curvature is set to RXO>>RXI and hence, the thickness of the panel portion 1 is made thin at the center portion and thick at the peripheral portion. Accordingly, a transmission light quantity of the panel portion 1 is small at the peripheral portion and hence, when the whole screen is viewed, the center portion is bright and the peripheral portion is dark.

To correct such difference of transmission light quantity, the film 211 is coated such that the thickness becomes large at the center portion and is decreased toward the peripheral portion thus adjusting the transmission light quantity whereby the substantially uniform brightness can be obtained over the entire region.

Figure 10A:
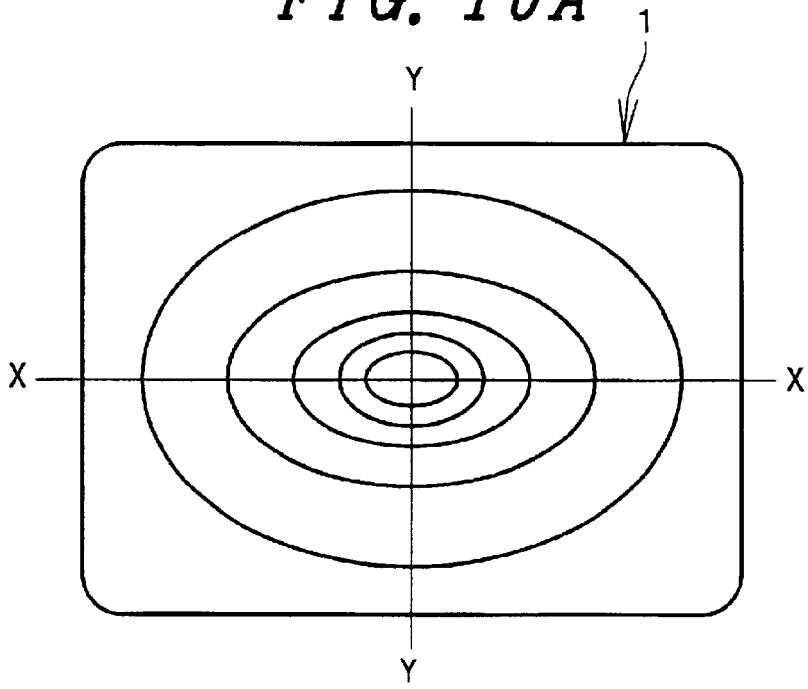
FIG. 10A is a view showing the thickness distribution of a panel portion 1 as viewed from an outer surface.
Figure 10B:
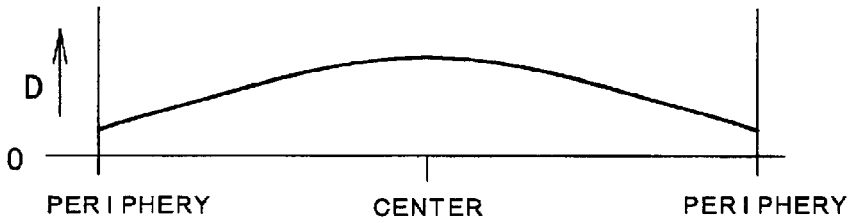
FIG. 10B is a view showing the thickness distribution of a film formed by using a spray coating device.
Figure 10C:
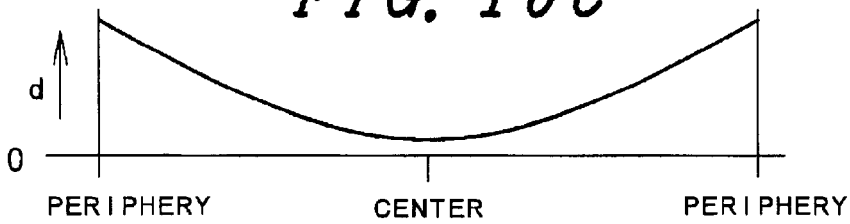
FIG. 10C is a view showing the thickness distribution of a panel along a line X—X in FIG. 10A.

FIG. 10A to FIG. 10C are explanatory views showing the thickness distribution of the film 211 and the thickness of the panel formed on the outer surface of the panel portion 1, wherein FIG. 10A shows an example of contour lines of the thickness distribution from the outer surface of the panel portion 1, FIG. 10B shows the thickness distribution of the film 211, and FIG. 10C shows the thickness distribution of the panel portion 1 along the X—X line of FIG. 10A.

As shown in FIG. 10C, the thickness d of the panel portion 1 is set such that the thickness d is thin at the center and is increased toward the periphery. To the contrary, as shown in FIG. 10B, the thickness D of the film 211 is set such that the thickness D is large at the center portion of the panel portion and is gradually decreased toward the peripheral portion in the X—X direction. Due to such a constitution, the light transmittivity becomes small at the center portion and large at the peripheral portion so that the substantially uniform brightness can be achieved over the whole area of the panel portion.

Although, in FIG. 10A, the thickness distribution of the panel is expressed by laterally elongated concentric ellipses (ellipses having long axes in the X direction) having the centers thereof at the center portion of the panel portion, the thickness distribution may be expressed by concentric circles or concentric oblong circles. Further, with respect to a cathode ray tube having a panel portion which is given a radius of curvature only in the X—X direction, the film 211 may be formed with the thickness distribution inverse to the above-mentioned thickness distribution.

Due to such a structure, the cathode ray tube can prevent the flat feeling of the panel portion from being damaged, can have the uniform brightness over the whole area, can obviate the deterioration of contrast, and can prevent the lowering of the color purity which is caused by the multiple reflection of the incident external light or the light irradiated from the phosphor on the inner and outer surfaces of the panel portion.

Further, in the flat-surface panel type cathode ray tube, as other correction means which can reduce more or less the deterioration of the brightness of display image at the peripheral portion derived from the thickness difference between the center portion and the peripheral portion of the panel portion, a technique which decreases the absorbance (light absorbing ratio) by changing the glass material of the panel portion is considered. However, this technique elevates the light transmittivity of the whole panel portion and hence, the contrast of the display image is loared. Further, the suppression effect which absorbs and attenuates the multiple reflection of light irradiated from the phosphor on the inner and outer surfaces of the panel portion using the glass material is loared and hence, the color purity is loared.

Further, the requirement for ergonomics of these days is strict and hence, a display device including this type of cathode ray tube is required to hold the function to suppress the undesired electromagnetic radiation and the function to prevent the reflection of external light. Accordingly, the display device has to satisfy these requirements.

The film 211 shown in FIG. 8 is formed such that either one of solutions for the reflection prevention layer and the electrification prevention layer is coated on the outer surface of the panel portion using a spray nozzle which is movable relative to the outer surface of the panel portion thus forming a layer having a gradient thickness and, thereafter, the other solution is coated onto the outer surface of the panel portion while rotating the panel portion thus coating another liquid of the uniform thickness using a spin method. As a result, the film 211 can have the function of the light transmission control layer.

When the thickness of the film 211 is made different between the center portion and the peripheral portion of the panel portion using the spray method, the relative moving speed between the spray nozzle and the panel is changed. However, in this case, it is difficult to obtain the thickness distribution of the film 211 having the light transmission control function as shown in FIG. 10A by moving the spray nozzle in two directions relative to the outer surface of the panel portion. Accordingly, in an actual operation, the thickness gradient is given mainly along one axial direction (X direction in FIG. 10A) of the panel portion in many cases.

In forming the multilayered film, a method which uses both of the spray coating device and the spin coating device makes the manufacturing device complicated. In this respect, as the coating method, the spin method is preferable to form the coating film having the uniform thickness using the simple apparatus constitution. This spin method also can reduce the manufacturing cost.

As has been described heretofore, according to the typical constitutions of the present invention, the difference of brightness of displayed images between the center portion and the peripheral portion of the panel portion derived from the thickness difference between the center portion and the peripheral portion of the panel portion, the lowering of contrast derived from the reflection on the inner surface of the panel portion, and the deterioration of quality of the displayed images derived from the lowering of the color purity can be attenuated. With respect to the flat panel type cathode ray tube, it becomes possible to provide the cathode ray tube which can attenuate the deterioration of the flat feeling derived from the setting of the curvature of the inner surface of the panel portion considerably larger than that of the outer surface of the panel portion, can exhibit the uniform brightness over the whole screen, and can satisfy the requirement for ergonomics.

What is claimed is:

1. A color cathode ray tube comprising a panel portion which constitutes an image display surface, a neck portion housing an electron gun and a funnel portion which connects the panel portion and the neck portion, wherein:

the panel portion includes a light transmission control layer and a low refractive index layer, and the light transmission control layer including lint particles which become transparent at least in part due to the irradiation of light and second particles having light absorbing ability and conductivity, and a number of the first particles is gradually increased toward a peripheral portion of the panel portion from a center portion of the panel portion, and the low refractive index layer has a refractive index lower than a refractive index of the light transmission control layer and is formed as a layer above the light transmission control layer.

2. A cathode ray tube according to claim 1, wherein the light transmission control layer is conductive.

3. A cathode ray tube according to claim 1, wherein the first particles are formed of a material selected from the group consisting of silver, aluminum, a halogen compound, end silver sulfide, and the second particles are formed of a material selected from the group consisting of a precious metal, nickel, chromium, titanium nitride, and a mixture of indium tin oxide (ITO) and a light absorption material.

4. A cathode ray tube according to claim 3, wherein at least some of the first particles are formed of silver.

5. A cathode ray tube according to claim 3, wherein at least some of the first particles are formed of aluminum.

6. A cathode ray tube according to claim 3, wherein at least some of the first particles are formed of a halogen compound.

7. A cathode ray tube according to claim 3, wherein at least some of the first particles are formed of silver sulfide.

8. A cathode ray lube according to claim 3, wherein at least some of the second particles are formed of a precious metal.

9. A cathode ray tube according to claim 3, wherein at least some of the second particles are formed of nickel.

10. A cathode ray tube according to claim 3, wherein at least some of the second particles are formed of chromium.

11. A cathode ray tube according to claim 3, wherein at least some of the second particles are formed of titanium nitride.

12. A cathode ray tube according to claim 3, wherein at least some of the second particles are formed of a mixture of indium tin oxide (ITO) and a light absorption material.

13. A cathode ray tube according to claim 1, wherein at least some of the first particles become transparent due to the irradiation of light and oxidation on an outer surface of the panel portion.

* * * * *